United States Patent [19]

Maslin et al.

[11] Patent Number: 4,583,460

[45] Date of Patent: Apr. 22, 1986

[54] PRINTING ROLL WITH DETACHABLE SLEEVES AND KIT THEREFOR

[75] Inventors: Roger F. Maslin; John D. Rolfe, both of Bristol, England

[73] Assignee: DRG (UK) Limited, Bristol, England

[21] Appl. No.: 607,031

[22] Filed: May 4, 1984

[30] Foreign Application Priority Data

May 5, 1983 [GB] United Kingdom ..... 8312384

[51] Int. Cl.[4] ..... B41F 13/10

[52] U.S. Cl. ..... 101/375; 101/401.3; 29/125; 29/126; 29/130

[58] Field of Search ..... 101/375, 376, 401.3; 29/125, 130, 126

[56] References Cited

U.S. PATENT DOCUMENTS

| | | | |
|---|---|---|---|
| 427,366 | 5/1890 | Robischung | 101/401.3 X |
| 615,906 | 12/1898 | Richardson | 29/126 X |
| 724,083 | 3/1903 | Chandler | 29/126 X |
| 797,166 | 8/1905 | Anderson | 29/125 X |
| 973,599 | 10/1910 | Wheat | 101/220 X |
| 1,553,352 | 9/1925 | Amidon et al. | 29/126 X |
| 1,572,233 | 2/1926 | Chamberlin | 29/126 X |
| 2,450,727 | 10/1948 | Haushalter | 101/375 X |
| 2,556,511 | 6/1951 | Affolter | 101/401.3 |
| 4,144,813 | 3/1979 | Julian | 101/375 X |

*Primary Examiner*—Clifford D. Crowder

*Attorney, Agent, or Firm*—Cushman, Darby & Cushman

[57] ABSTRACT

Sleeves with different circumferences (and hence print repeat lengths) are removably mountable on a roll core, making use of radial compressibility of the radially inner region of each sleeve. The radially outer regions are incompressible, to ensure good print quality.

A sleeve may have inner and outer regions of different foam materials. Alternatively it may employ spaced discs having resilient arcuate tongues engaging an inner sleeve. An outer sleeve may be defined by slats engaging the discs, or peripheral flanges of the discs.

15 Claims, 15 Drawing Figures

PRINTING ROLL WITH DETACHABLE SLEEVES AND KIT THEREFOR

The present invention relates to printing rolls with detachable sleeves, and to the sleeves themselves.

Many forms of printing are carried out using a printing roll. A printing roll may be made of steel, and is an expensive item. Therefore composite printing rolls have been devised, comprising a printing sleeve which can be mounted and demounted on a printing roll core. In particular, our British Patent Specification No. 1,581,232 discloses a printing roll core having an outer surface which has one longitudinal end of a diameter greater than that of its other longitudinal end, and apertures serving as compressed gas outlets positioned remote from the ends of the core. A sleeve is so dimensioned that, in its working position, it forms an interference fit under stress with the outer surface of the core. In the unstressed condition of the sleeve, one end has an internal diameter between the maximum external diameter of the core and the external diameter (or the maximum external diameter) of that portion of the core with gas outlets in its surface. Thus, to fit a sleeve onto a core the sleeve is moved onto the core from the end of the core of lesser diameter, loading with the end of the sleeve with the greater internal diameter, until the sleeve and core touch around the inner circumference of the sleeve. In this configuration, the sleeve covers all the gas outlets in the core surface. Gas under pressure is then applied inside the sleeve through the gas outlets in the core to expand the sleeve radially, whereupon it can be moved to its designed working position on the core. The supply of gas is then ceased, and the sleeve then makes the interference fit with the core in its working position.

This has been very successful. It allows one (relatively expensive) core to be used with any number of (relatively cheap) printing sleeves. After use, a sleeve can be removed and stored until it is again desired to use it for printing.

Generally, for good quality printing, it is necessary for the printing roll to present a hard, substantially incompressible printing surface. The composite printing roll just described may have a thin sleeve of a glass reinforced plastics material (GRP), which in use fits tightly on a core, e.g. of steel. Thus the desired rigidity is readily achieved.

When printing by means of a printing roll, the repeat length of the copy is essentially equal to the circumference of the printing roll. With a composite printing roll as just described, this is determined by the size of the roll core. If it is desired to alter the repeat length substantially, then it is necessary to use a different roll core (and, of course, a different sleeve). This means that it is still necessary to have a number of different, and expensive, roll cores.

The present invention makes it possible for a single roll core to be used for printing with a plurality of different repeat lengths.

According to the present invention in a first aspect, there is provided a detachable sleeve for a printing roll, the sleeve having a radially inner core-contacting surface and, radially spaced therefrom, an outer surface, characterised in that the inner surface is coupled to the outer surface by coupling means comprising a radially compressible inner portion adjacent the inner surface; and a relatively incompressible outer portion adjacent the outer surface.

Such a sleeve can be mounted on a core as described in GB No. 1,581,232, since the compressibility of the inner portion allows the inner surface of the sleeve to expand radially under the influence of the gas applied through the outlets in the core surface. However, the sleeve can be effectively incompressible by pressure applied to the radially outer surface.

In one embodiment, the compressible inner portion may be provided by an annular region of compressible plastics foam, e.g. closed cell polyethene. The incompressible outer portion may be provided by an annular region of rigid plastics foam, e.g. closed cell polyurethane. The inner and outer surfaces may be provided on thin annular glass fibre reinforced layers, the external one being provided with a ground outer surface.

In another embodiment, the coupling means comprises a multiplicity of discs disposed along the axis of the sleeve parallel to a radial plane, each disc extending radially between an inner tube providing said radially inner surface, and an outer tube providing said radially outer surface. Each disc has a radially compressible inner portion and a relatively radially incompressible outer portion. For example, a disc, e.g. of thin metal, may comprise in its radially inner region a multiplicity of tongue portions which are bent out of the radial plane and which are capable of resilient bending to provide said compressibility.

In a third embodiment, the sleeve may comprise a multiplicity of cup like portions. Each cup has a disc portion analogous to a disc of the second embodiment, and a generally cylindrical wall portion, such that cups can be serially engaged with each cup partly received within the next one, and the cylindrical wall portions of the series defining said radially outer surface.

It will be appreciated that compressibility and incompressibility are relative terms. In particular, it should be realised that the pressure that may by exerted on the inner portion during mounting of a sleeve on a core as described in GB No. 1,581,232 can be very much greater than the pressures which will be exerted on the exterior of the roll during normal printing processes.

In further aspects, the invention provides a combination of a roll core and a sleeve; and a method of mounting a sleeve on a roll core.

Some preferred embodiments of the invention will now be described in greater detail with reference to the accompanying drawings, in which.

All of the illustrated embodiments have an inner sleeve 10 which, in use, contacts a printing roll core. This inner sleeve 10 may be identical to a sleeve as disclosed in GB No. 1,581,232, except that, of course, it is not provided with printing means such as a rubber layer. Thus, the inner sleeve 10 may be formed from a fibre-reinforced resin such as a glass reinforced polyester or glass reinforced epoxy resin which has been laid-up on a former having a desired taper, to a depth of about 1.5 mm. It is allowed to harden to form the seamless inner sleeve 10. Its outer (cylindrical) surface may have the same shape as the former (i.e. slightly tapered), or it may be ground to form a parallel cylinder.

Figure 1:
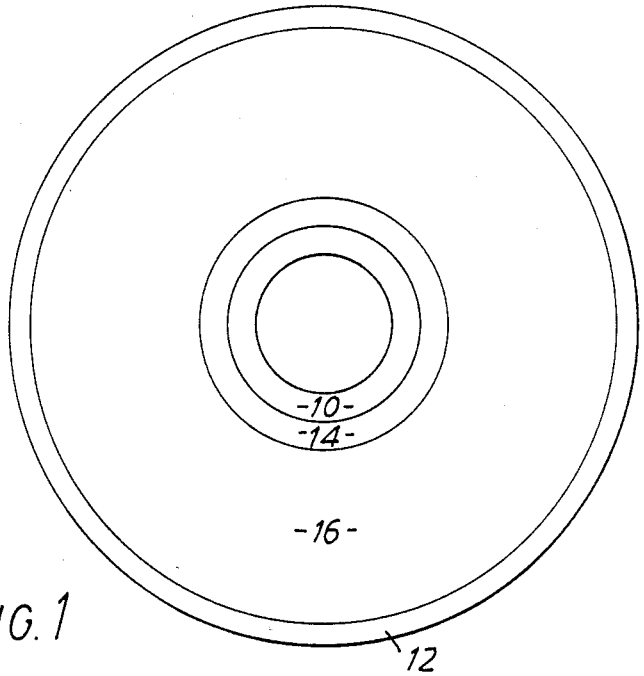
FIG. 1 is a schematic sectional view in a radial plane through a printing sleeve according to a first embodiment of the invention.

Referring now to FIG. 1, the first illustrated embodiment has the form of a thick walled tube, whose inside and outside are defined by the inner sleeve 10 and an outer sleeve 12 which may also be of glass fibre. The outer surface may be ground to facilitate mounting of the printing means (which may be of rubber, aluminium or copper depending on whether the printing process is to be flexography, lithography, or gravure printing). In FIG. 1, the thicknesses of the sleeves 10, 12 are greatly exaggerated. As exemplified in GB No. 1,581,232, the inner sleeve 10 may have a thickness of about 1.5 mm, and a diameter of about 140 mm (tapering by about 5 parts in 20,000 over a length of about 500 mm). The outer sleeve 12 may be rather thicker than the inner sleeve 10.

An annular layer 14 of a compressible plastics foam (e.g. a closed cell polyethene) is secured to the outer surface of the inner sleeve 10. An outer layer 16 of greater radial extent is secured to the outer surface of the inner layer 14, and has the outer sleeve 12 secured on its outer surface. The second annular layer 16 is of rigid foam (e.g. a closed cell polyurethane).

Figure 2:
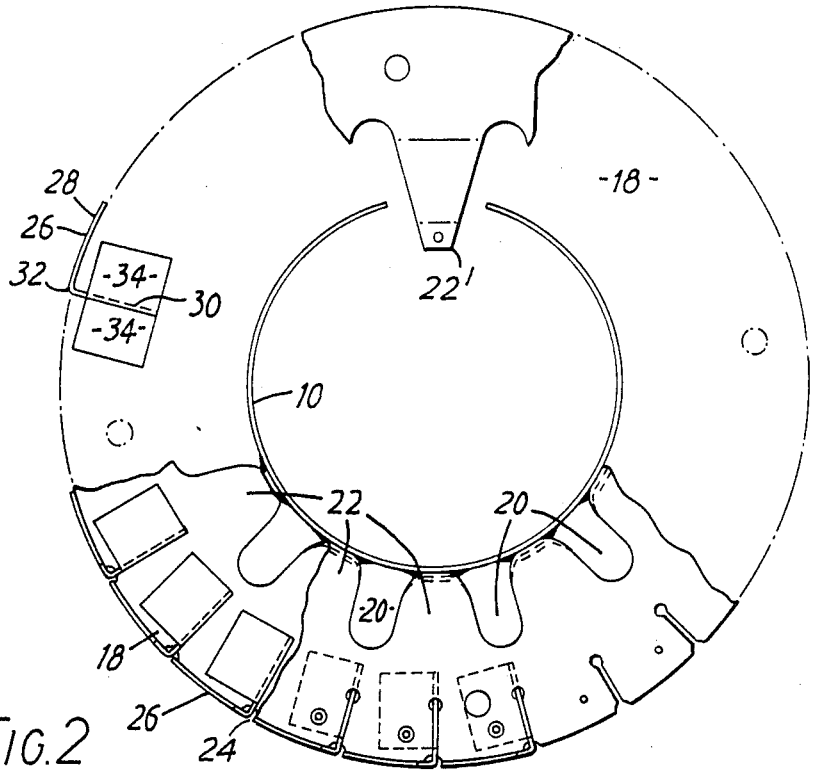
FIG. 2 is a sectional view in a radial plane of a second embodiment of printing sleeve which includes metal discs; the drawing is fragmentary, and includes a portion of a disc in an earlier stage.
Figure 3:
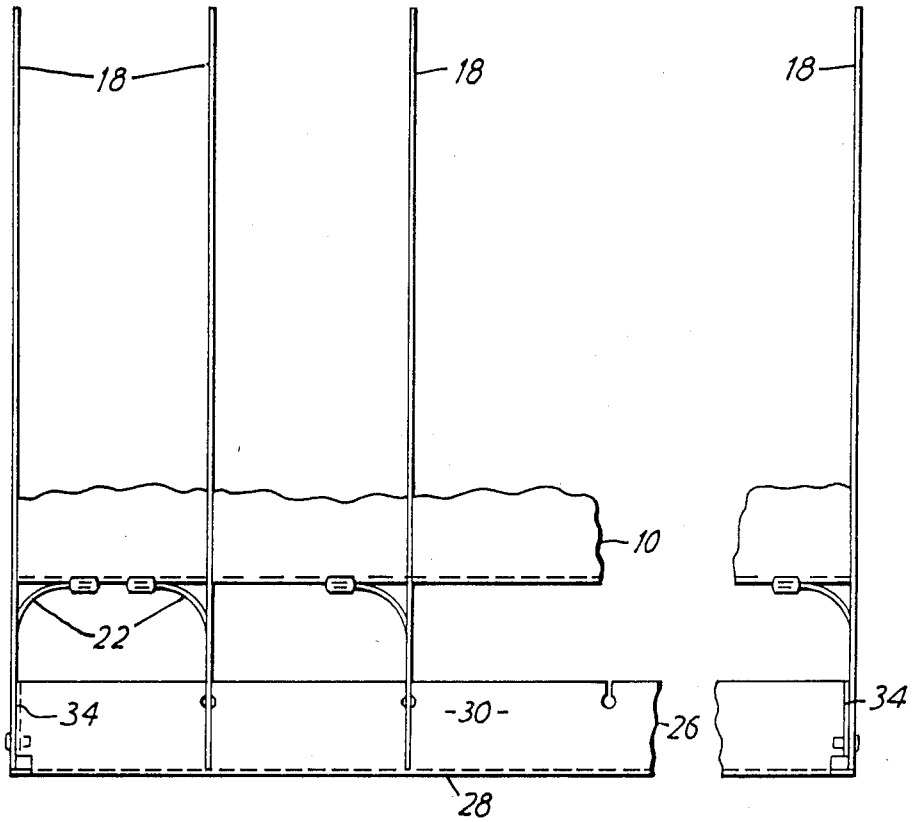
FIG. 3 is a partial view of the FIG. 2 embodiment seen from the side (perpendicular to the axis)

A second embodiment of the invention will now be described with reference to FIGS. 2 to 8 of the drawings. This may have at least an inner sleeve 10 as described in connection with the first embodiment. But outwardly of this, there is not, or need not be, a solid body. There are a multiplicity of annular discs 18 located along the axis. Each disc has, from its radially inner edge, a plurality of cut-outs 20 so that tongue portions 22 are defined between adjacent cut-outs 20. If the disc 18 were planar, the tongues 22 would extend inwardly beyond the inner sleeve 10. But, at least in use, the tongues are bent out of the radial plane, as may be seen in FIG. 5. The material and shaping of the disc 18 is such that it can be threaded over the inner sleeve 10 so as to contact it with its bent tongue portions 22, which are resiliently deformable. Suitably, the disc is of sheet metal, such as light alloy sheeting. It can thus be produced in flat form, and the tongue portions can then be bent as required. In FIG. 2, a single tongue portion 22′ is shown in its unbent original state.

Figure 4:
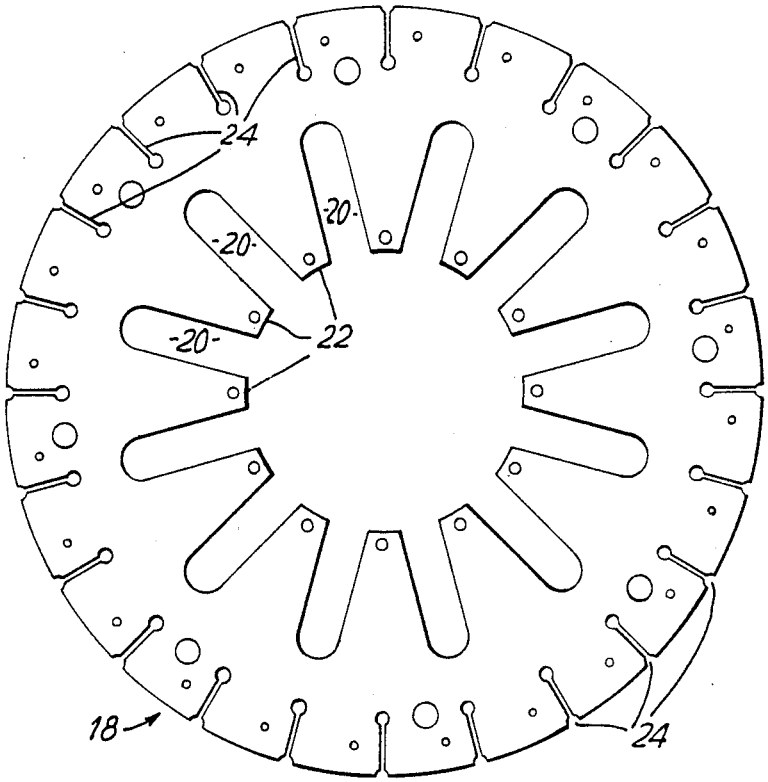
FIG. 4 shows a disc of the second embodiment, in its unbent state.
Figure 5:
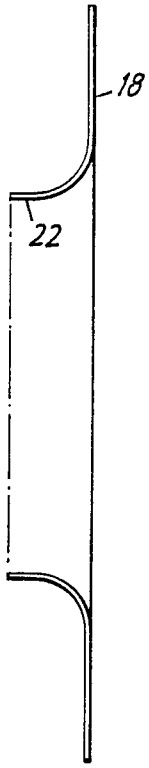
FIG. 5 is a partial axial section of the disc shown in FIG. 4, but showing the tongue portions after bending.

The outer edge of the disc 18 has a multiplicity of radial slots 24, as is best seen in FIG. 4. The discs 18 are arranged on the inner sleeve 10 so that the slots of all the discs are aligned. A multiplicity of elongate L-section slats 26 equal in number to the number of slots 24 in each disc are located so that one arm 30 is within an aligned set of slits 24, whereas the other arm 28 overlies the outer edge of the discs 18. Each slat 26 extends over the whole axial length of the sleeve. The ends discs 18 both have inwardly directed tongues 22, and are secured to tabs 34 of the slots 26.

Figures 6, 7, 8:
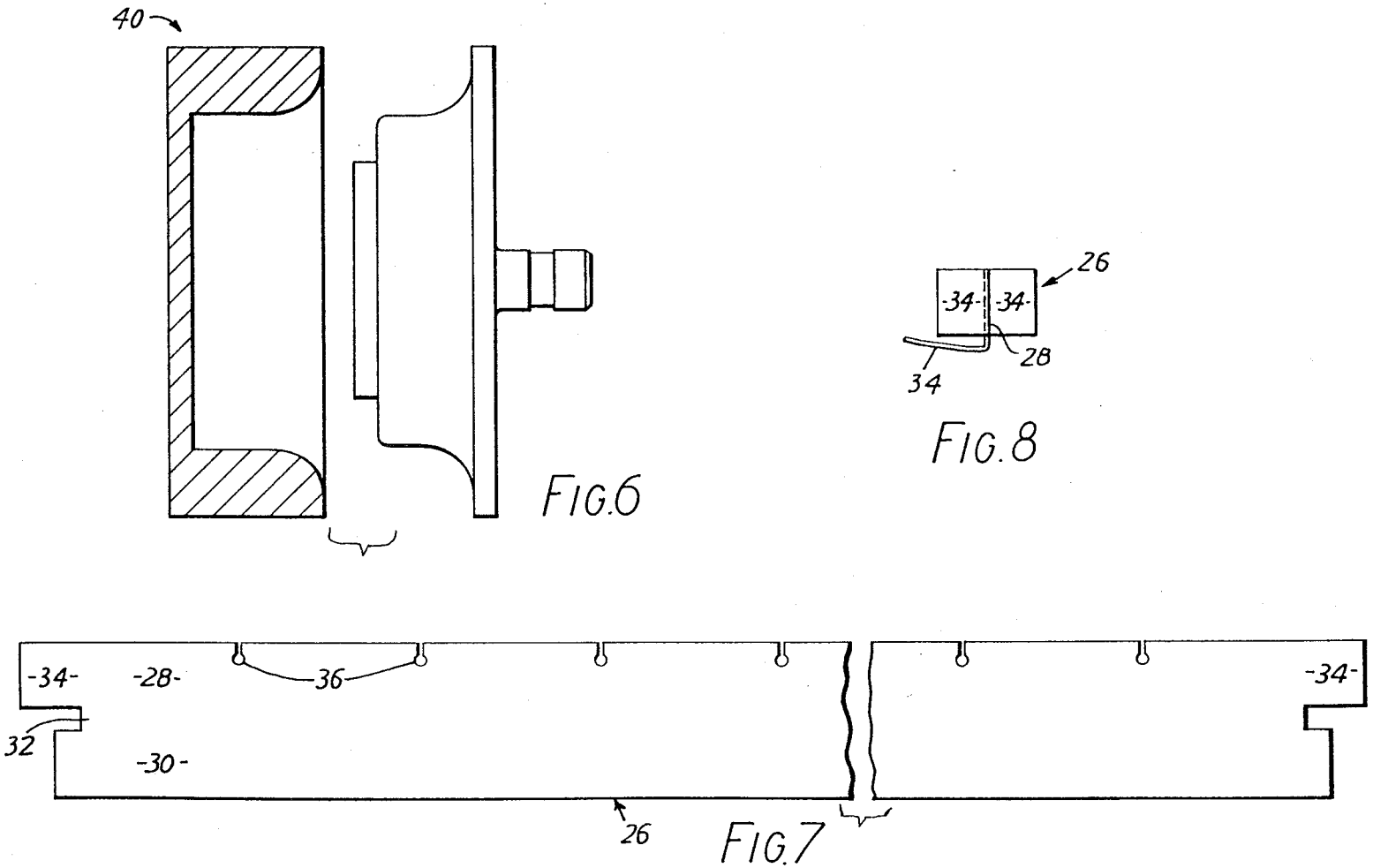
FIG. 6 shows a press-tool for use in forming the discs.
FIG. 7 shows a slat used in conjunction with the discs in the second embodiment.
FIG. 8 is an end view of the slat in its folded state.

The slats 26 may be produced from sheet metal stampings, as shown in FIG. 7. Thus, a stamping has two generally rectangular elongate portions which will define respective arms 28, 30. They are connected by an intermediate piece 32 which is of slightly shorter longitudinal extent than the arm 30, which in turn is rather shorter than the arm 28. Thus the arm 28 has a respective tab portion 34 at either end. When the blank is bent to form the slat 26, the tabs 34 are bent over at right-angles so that they lie in radial planes, and serve to hold the assembly together. The arm portions 28 are preferably given a slight curvature so that, as may be seen in FIG. 2, they define a reasonably smooth cylindrical surface. The arm 28 may have a multiplicity of transverse slots 36 which, in use, extend radially and embrace respective discs 18 radially inwardly of the ends of the slots 24. This assists in locating the components positively.

FIG. 6 shows a press-tool 40 for use in bending the tongue portions 22 of a metal disc 18.

The discs 18 may be secured to the inner sleeve 10, preferably when it is mounted on its former or mandrel, for example using the GRP resin or other suitable adhesive.

In use, printing means are mounted on the outer cylindrical surface of the assembly. Sometimes, it may be possible to mount these directly on the cylindrical surface defined by the curved legs 28 of the slats 26. However, it will usually be preferable to provide an outer sleeve 12, which may be laid-up on the legs 28. It may then be ground to form an accurately parallel printing roll.

Under some conditions, the surface defined by the slats 26 is insufficiently smooth owing to axially extending gaps or discontinuities between adjacent slats. This problem is overcome by the third embodiment, shown in FIGS. 9 to 15. This can be regarded as a development of the second embodiment in which each disc 18 has an axially extending outer portion around its whole perimeter, like the wall of a cup. Thus when the modified discs or cups are assembled together, they define an outer cylindrical surface, devoid of axially extending gaps, and without the need for separate slats.

Figure 9:
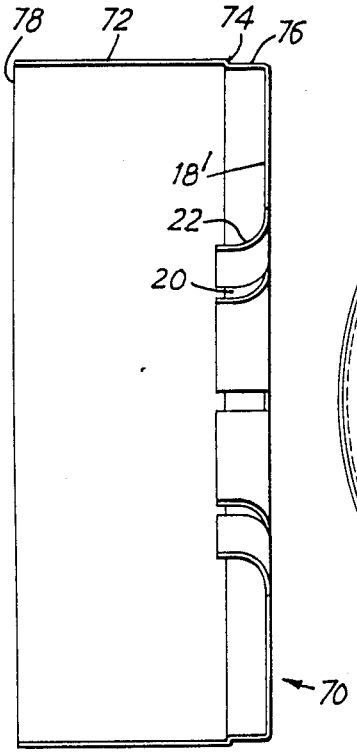
FIGS. 9 and 10 are side and front views of a cup used in a third embodiment.
Figure 10:
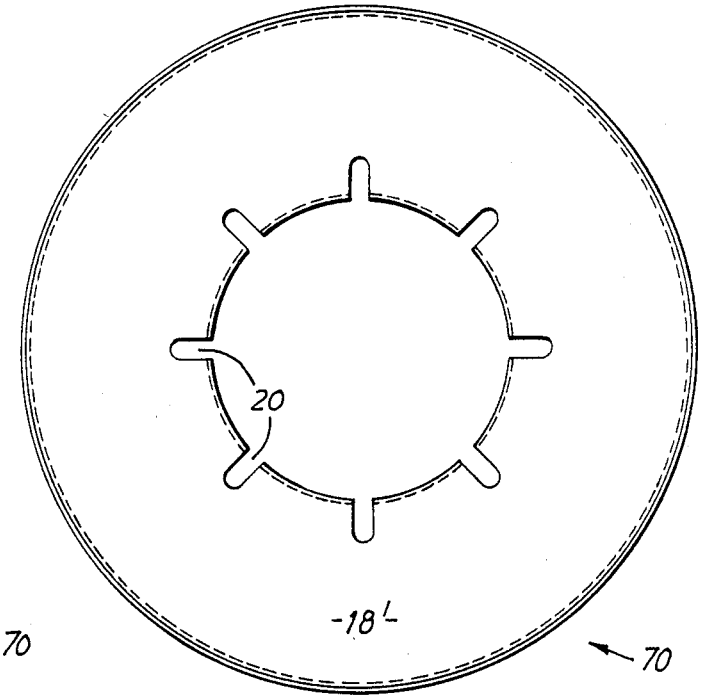
Figure 11:
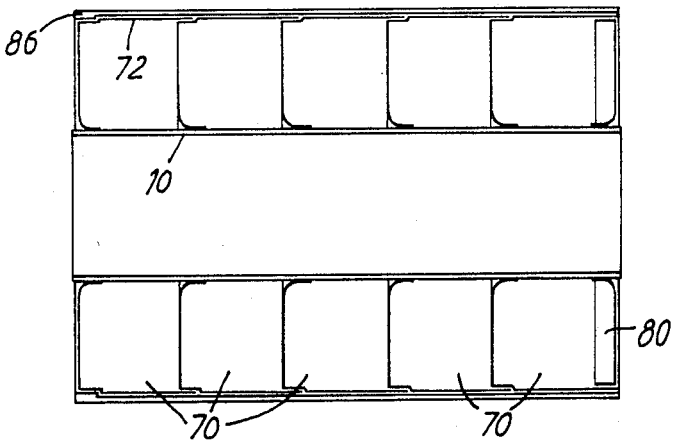
FIG. 11 is an axial section through a sleeve of the third embodiment.

Referring to FIGS. 9 and 10, a cup 70 has a radially inner portion that may be just the same as the corresponding portion of a disc 18 of the second embodiment. Thus, there are cut-outs 20 defining tongue portions 22 which curve out of the plane of the disc portion 18′ but the radially outer portion of the disc portion 18′ does not terminate in a slotted edge. Instead, as can be seen best from FIG. 9, it is continuous with an axial wall portion 72, which extends in the same axial direction as the projection of the tongues 22. Over most of its axial extent, the wall portion 72 is uniformly cylindrical. But adjacent the disc portion 18′, there is a step 74 leading to a spigot portion 76 of slightly reduced diameter. The size of the step 74 is related to the thickness of the material of which the cup 70 is produced, so that, as will be described later, the spigot portion 76 of one cup 70 is receivable within the mouth 78 of another.

A cup 70 may be produced from a disc of metal, suitably aluminium, by a series of forming operations. The central aperture and the cut-out 20 may be produced first, and the tongues 22 are then turned out of the radial plane so that their inner portions can lie on the cylindrical surface of an inner sleeve 10. An outer edge portion of the disc is then turned over (by spinning) to form a cylindrical surface with a step 74 and reduced-diameter spigot portion 76.

In use, a multiplicity of cups 70 are fed onto an inner sleeve 10, and may be secured in place e.g. by an epoxy resin. As may be seen from FIG. 11, all of the cups 70 face the same way, and the spigot portion 76 of one is received within the mouth 78 of its neighbour. Slight adjustment of the length of the sleeve can be accommodated by adjusting the extent to which the spigots are so received. When the cups 70 have been properly mounted on the sleeve 10, the open mouth 78 of the final cup 70 is closed by mounting an end member 80 on the sleeve 10.

Figure 13:
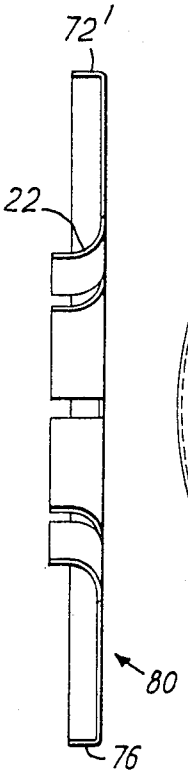
FIGS. 13 and 14 are side and front views of an end plate of the sleeve.
Figure 14:
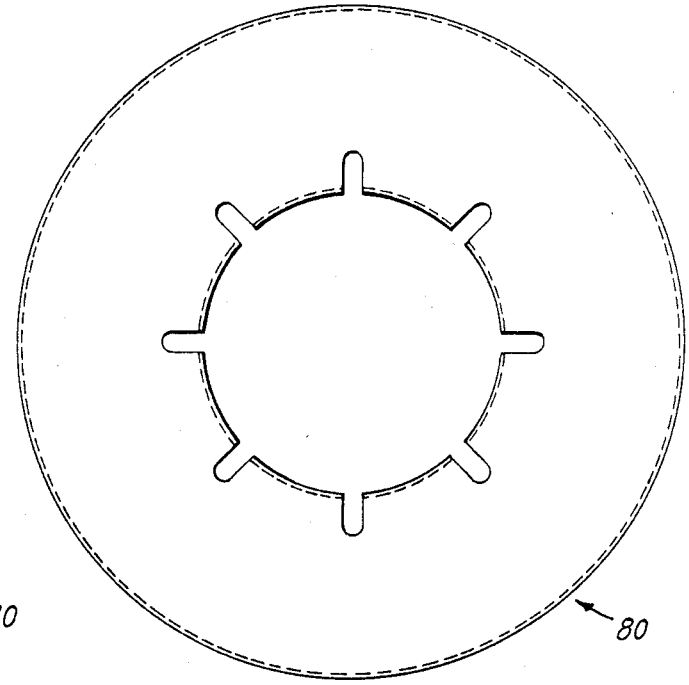

As shown in FIGS. 13 and 14, an end member 80 is essentially identical to a cup 70, except that the axial wall portion 72' is much shorter, having only a spigot portion 76. The end member 80 is mounted in the opposite orientation to the ordinary cups 70, that is, its tongue portions 22 and axial wall 72' are opposed to those of the cup 70 with which it engages (and to those of all the other cups too).

Figure 15:
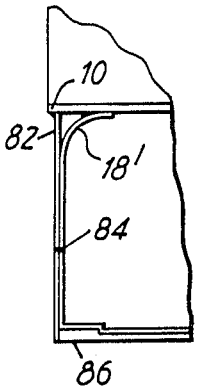
FIG. 15 is a detail from FIG. 11 on a larger scale.
Figure 12:
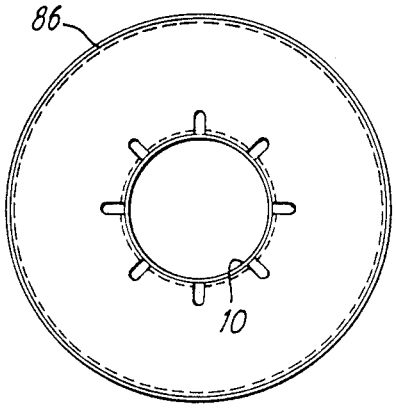
FIG. 12 is an end view of the sleeve of FIG. 11.

In some printing processes, the printing rolls are at least partly immersed in liquids. To prevent the roll assemblies from filling with liquid, the ends of the roll may be closed by discs. Of course, such closures may be desirable even when different printing techniques are being employed. Details of an end disc assembly are shown in FIG. 15. A closure disc 82 is secured by rivets 84 to the disc portion 18' of the end cup 70. The closure disc 82 is annular, its inner margin being very slightly spaced from the cylindrical surface of the inner sleeve 10, so as to allow for the very slight expansion of the inner sleeve when it is being mounted on a printing roll. The disc 82 is sealed to the sleeve 10 by a sealant fillet, suitably of a silicone material, which is sufficiently flexible to allow said movement. The outer region of the disc 82 is similarly sealed to an outer region of the cup 70.

At the other end of the roll, the end member 80 is fitted with a like closure disc 82.

The assembly of cups 70 is generally provided with a rubber outer layer 86. This may be cured in position, after dipping in a rubber solution. Alternatively, it may be a sheet, or may be a spirally wound strip. In use, a rubber stereotype is then attached to the rubber layer 86. As may be seen in FIG. 15, the closure disc 82 extends outwardly as far as the rubber layer 86, and is sealed thereto.

The rubber layer 86 on a sleeve may be stripped off and replaced by one of a different thickness, thus changing slightly the repeat length of the printing roll.

It will be appreciated that various of the features described in connection with particular embodiments may be more widely applicable. For example, the use of different thicknesses of rubber outer layers for minor variations in repeat length is very widely applicable.

We claim:

1. A printing roll kit comprising:

a roll core;

a plurality of printing sleeves each of said printing sleeves being mountable on said roll core, each of said printing sleeves differing in circumference, and each of said printing sleeves having;

a detachable sleeve adapted for fitting onto a printing roll core, said detachable sleeve including an inner sleeve adapted for radial expansion by a gas, having an inner surface and an outer surface, and an outer cylindrical portion having an inner surface and an outer surface, said outer cylindrical portion radially spaced from said inner sleeve;

an inner portion radially located between said inner sleeve and said outer cylindrical portion, said inner portion being compressible, having a multiplicity of resilient members about said inner sleeve, said resilient members being resiliently deformable by radial expansion of said inner sleeve; and means for coupling said inner sleeve to said outer cylindrical portion, said coupling means including a multiplicity of discs disposed along the axis of said inner sleeve, each disc having a radially compressible inner portion and a radially relatively incompressible outer portion, substantially incompressible by normal printing forces.

2. A printing sleeve comprising:

a detachable sleeve adapted for fitting onto a printing roll core, said detachable sleeve including an inner sleeve adapted for radial expansion by a gas, having an inner surface and an outer surface, and an outer cylindrical portion having an inner surface and an outer surface, said outer cylindrical portion radially spaced from said inner sleeve;

an inner portion radially located between said inner sleeve and said outer cylindrical portion, said inner portion being compressible, having a multiplicity of resilient members about said inner sleeve, said resilient members being resiliently deformable by radial expansion of said inner sleeve;

means for coupling said inner sleeve to said outer cylindrical portion, said coupling means including a multiplicity of discs disposed along the axis of said inner sleeve, each disc having a radially compressible inner portion and a radial outer portion substantially incompressible by normal printing forces.

3. A printing sleeve according to claim 2 wherein one or both of said inner surface of said inner sleeve and said outer surface of said outer cylindrical portion is a thin annular glass fiber reinforced layer.

4. A printing sleeve according to claim 3 wherein said outer surface of said outer cylindrical portion is a ground surface of said thin annular glass fiber reinforced layer.

5. A printing sleeve according to claim 2 wherein said resiliently deformable members of each disc have tongue-like portions which are bent out of the radial plane and which are capable of resilient bending to provide said compressibility.

6. A printing sleeve according to claim 2 wherein each of said discs has a generally cylindrical wall portion so as to define a cup-like structure having an opening the same diameter of said cylindrical wall portion, such that said cup-like structures can be serially engaged with each other, said cup-like structures are partly received within the next serially located cup-like structure, and said cylindrical wall portions of said serially engaged cup-like structures define said radial, relatively incompressible outer portion.

7. A printing sleeve according to claim 6 wherein said cylindrical wall portion of each of said cup-like structures has a spigot portion of reduced diameter for insertion into said opening of the next said serially located cup-like structure, the degree of insertion being selectable.

8. A printing sleeve comprising:

a detachable sleeve adapted for fitting onto a printing roll core, said detachable sleeve including an inner sleeve adapted for radial expansion by gas, having an inner surface and an outer surface, and an outer cylindrical portion having an inner surface and an outer surface, said outer cylindrical portion radially located from said inner sleeve and substantially incompressible by normal printing forces; and means for coupling said inner sleeve to said outer cylindrical portion, forming an inner portion radially located between said inner sleeve and said outer cylindrical portion, said inner portion being compressible, having a multiplicity of resilient members about said inner sleeve, said resilient members being resiliently deformable by radial expansion of said inner sleeve.

9. A printing sleeve according to claim 8 wherein one or both of said inner surface of said inner sleeve and said outer surface of said outer cylindrical portion is a thin annular glass fiber reinforced layer.

10. A printing sleeve according to claim 9 wherein said outer surface of said outer cylindrical portion is a ground surface of said thin annular glass fiber reinforced layer.

11. A printing sleeve according to claim 8 wherein said coupling means includes a multiplicity of discs disposed along the axis of said inner sleeve, each disc having a radially compressible inner portion and a radial outer portion substantially incompressible by normal printing forces.

12. A printing sleeve according to claim 11 wherein each of said discs has resiliently deformable members bent out of the radial plane, attached to said inner sleeve and which are capable of resilient bending to provide said compressibility.

13. A printing sleeve according to claim 11 wherein each of said discs has a generally cylindrical wall portion located at the radial periphery of said disc so as to define a plurality of cylindrical structures, said cylindrical structures having two ends, one end defining an opening and said second end being closed and of smaller diameter than said open end, said cylindrical structures being serially engaged by the closed end inserting into the open end of an adjacent cylindrical structure, the degree of insertion being selectable, said serially engaged cylindrical structures providing an outer surface which is substantially incompressible under normal printing forces.

14. A printing sleeve according to claim 11 wherein said discs are of a selectable uniform diameter thus providing a printing sleeve of selectable circumference and hence selectable printing repeat length.

15. A printing roll kit comprising:

a roll core:

a plurality of printing sleeves each of said printing sleeves being mountable on said roll core with each of said printing sleeves having different circumferences and each of said printing sleeves including:

a detachable sleeve adapted for fitting onto a printing roll core, said detachable sleeve including an inner sleeve adapted for radial expansion by a gas, having an inner surface and an outer surface, and an outer cylindrical portion having an inner surface and an outer surface, said outer cylindrical portion radially located from said inner sleeve and substantially incompressible by normal printing forces; and means for coupling said inner sleeve to said outer cylindrical portion, forming an inner portion radially located between said inner sleeve and said outer cylindrical portion, said inner portion being compressible, having a multiplicity of resilient members about said inner sleeve, said resilient members being resiliently deformable by radial expansion of said inner sleeve.

* * * * *